United States Patent [19]

Eckel

[11] Patent Number: 4,570,384

[45] Date of Patent: Feb. 18, 1986

[54] DOOR MOUNT AND DOOR NOSE

[75] Inventor: Alan Eckel, Westford, Mass.

[73] Assignee: Eckel Industries, Inc., Cambridge, Mass.

[21] Appl. No.: 740,237

[22] Filed: May 31, 1985

Related U.S. Application Data

[63] Continuation of Ser. No. 535,584, Sep. 26, 1983, abandoned.

[51] Int. Cl.[4] ..... E06B 3/00

[52] U.S. Cl. ..... 49/501; 49/237; 49/462; 52/823; 160/354

[58] Field of Search ..... 49/501, 388, 462, 237; 52/813, 814, 815, 821, 822, 823, 716–718; 160/354, 235, 91

[56] References Cited

U.S. PATENT DOCUMENTS

| | | | |
|---|---|---|---|
| 1,205,707 | 11/1916 | Cahill | 160/235 X |
| 2,184,259 | 12/1939 | Seaman | 49/388 X |
| 2,350,287 | 5/1944 | Michelman | 160/235 X |
| 2,773,726 | 12/1956 | Johansson et al. | 52/823 X |
| 3,710,839 | 1/1973 | Andres | 160/91 X |
| 4,064,924 | 12/1977 | Catlett | 160/354 |
| 4,084,347 | 4/1978 | Brown | 49/501 X |
| 4,124,955 | 11/1978 | Kochis | 49/237 |
| 4,292,764 | 10/1981 | Kochis | 49/237 |
| 4,397,117 | 8/1983 | Shipp | 49/501 |

*Primary Examiner*—Philip C. Kannan

*Attorney, Agent, or Firm*—Schiller & Pandiscio

[57] ABSTRACT

An improved door having a door nose and a door mounting component which attach to the door panel in a manner which minimizes fastener exposure on the outer surface of the door and reduces cost of assembly.

17 Claims, 5 Drawing Figures

DOOR MOUNT AND DOOR NOSE

This application is a continuation of application Ser. No. 535,584, filed Sept. 26, 1983, now abandoned.

IMPROVED DOOR MOUNT AND NOSE

The present invention relates to an improved door structure and more particularly to improved door mount and door nose means having minimal fastener exposure at the outer surface of the door.

THE PRIOR ART

Door structures having a separate mounting member and a separate nose member are well known. Such doors typically open and close by swinging on a door post member which is rotatably attached to a side door jamb. Some examples of this type of door are disclosed in U.S. Pat. Nos. 4,292,764, 4,124,955, 4,122,887, 3,979,872, and 3,797,165. Heretofore, attachment of the door mounting and nose member has been a time consuming and relatively expensive process. An additional esthetic objection is that prior designs require the use of a relatively large number of surface fasteners (i.e., fasteners exposed at the outer surface of the door) to attach the mount and nose to the door. Also doors having exposed fasteners generally are not acceptable for reasons of sanitation in food processing plants where there is a possibility of food coming into direct contact with doors.

OBJECTS OF THE INVENTION

Accordingly, a primary object of the present invention is to provide a door which eliminates or substantially reduces the problems noted above.

A more specific object is to provide a door having a nose that is attached by fasteners concealed within the door nose.

Another specific object is to provide a door having a door mount that is mechanically attached by a plurality of fasteners, with only a minimum number of the fasteners being surface fasteners and the remainder concealed within the door mount.

Still another object of the invention is to provide an improved door construction which may have a wear surface near its bottom edge and/or a resilient air shield attached to the door mount, and is adapted for easy attachment of the door mount hardware and door nose.

A still further object is to provide a door utilizing the present invention which has an improved door post configuration consisting of upper and lower door post sections.

SUMMARY OF THE PRESENT INVENTION

The foregoing objects, and other objects which will become apparent as the nature of the invention is better understood, are achieved by providing a door which comprises a stiff or rigid door panel, a door mount, a door nose, and improved means for attaching the door mount and/or door nose to the door panel. In the preferred embodiment hereinafter described, the door mount and door nose are similarly attached to the door panel, and the door is mounted to a door jamb by upper and lower bearings and two separate door post sections attached to the door mount and received by the two bearings.

The mount and nose are assembled with the door panel by sliding them endwise onto the side edges of the panel. The mount and nose each have hollow sections and parallel flanges projecting laterally from the hollow sections. The flanges are spaced apart just enough to allow the door panel to make a sliding fit between them. The side edges of the door panel have roll pins inserted perpendicular to the panel so that the ends of the pins protrude from the front and back of the door panel. The hollow section of the mount and nose enclose these roll pins. The pins prevent the mount or nose from being pulled away from the door panel in a lateral direction. Additional means are used to prevent the door mount and nose from shifting longitudinally relative to the panel.

GENERAL DESCRIPTION OF THE DRAWINGS

For a fuller understanding of the nature and objects of the present invention, reference should be had to the followig description taken in connection with the accompanying drawings wherein.

DETAILED DESCRIPTION OF THE DRAWINGS

Figure 1:
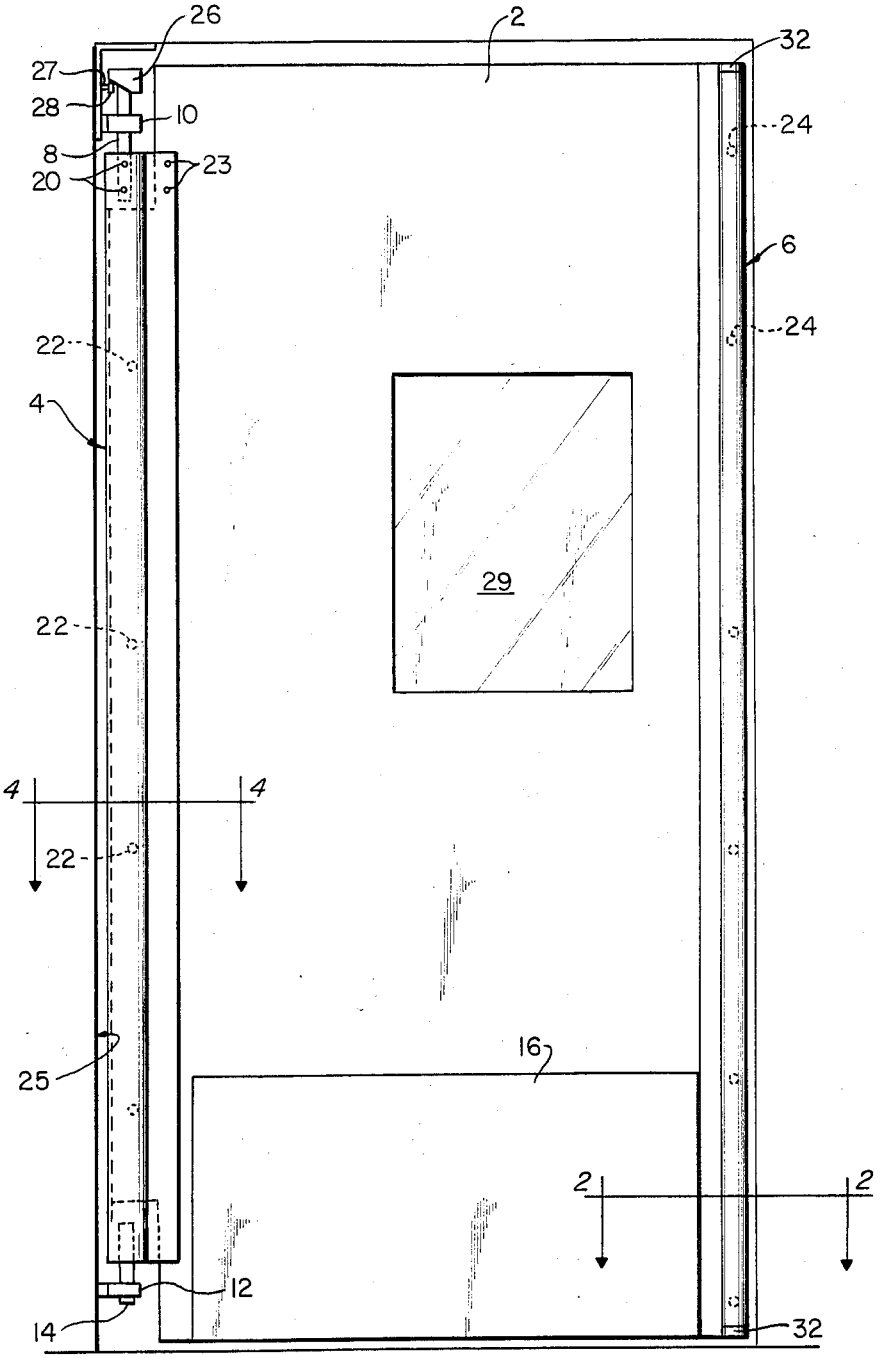
FIG. 1 is a front view in elevation of a door of the present invention.

Turning first to FIG. 1, the preferred embodiment of the present invention comprises a stiff or rigid panel 2, a door mount 4, a door nose 6, an upper door post section 8, an upper journal bearing 10, a lower journal bearing 12, a lower door post section 14, a wear plate 16, an air shield 18 (omitted from FIG. 1 but shown in FIG. 4), and various other components described hereinafter.

One side edge of panel 2 is attached to door post section 8 by mount 4. Two fasteners 20, such as screws, rivets, roll pins or the like, extend through mount 4 and post 8, so as to affix the door mount 4 to upper post section 8. Mount 4 is prevented from separating from panel 2 laterally by roll pins 22 (shown in phantom in FIG. 1; also see FIG. 4). One and preferably two fasteners 23 secure mount 4 to panel 2. Door nose 6 is similarly connected to panel 2 by roll pins 24 (FIGS. 1 and 2) in order to prevent lateral movement of nose 6. Roll pins 22 are vertically aligned so as to form a straight column down the side of panel 2. Roll pins 24 are similarly aligned along the opposite edge of panel 2. The assembly of door mount 4 and door nose 6 to door panel 2 is accomplished by (a) inserting roll pins 22 and 24 in suitable holes provided in panel 2 near its side edges, and (b) sliding door mount 4 and door nose 6 lengthwise over roll pins 22 and 24, so that mount 4 encloses pins 22 and nose 6 encloses pins 24.

Upper bearing 10 serves as a journal bearing for upper door post section 8. Also associated with upper door post section 8 is a roller-type cam assembly which functions to return the door to its shut at-rest position after it has been swung open and then released. The roller type cam assembly comprises a cam 28 mounted on shaft 8, and a roller cam follower 26 on the end of a stub shaft 27 affixed to an angle iron support 29. Angle iron support is attached to a door jamb 25. A detailed description of cam 28 and follower 26 is not included here since they are adequately described in greater detail in my U.S. patent application Ser. No. 468,570 for "DOOR CAM HARDWARE" filed on Feb. 22, 1983. Also the illustrated cam assembly is not essential to the invention and may be replaced by other known equivalents, e.g., a cam assembly of the type shown in U.S. Pat. Nos. 4,292,764, 4,124,955, and 4,122,887.

As illustrated in FIG. 1, upper door post section 8 extends partially into the top portion of mount 4 so as to receive fasteners 20 and render it fixed relative to door panel 2.

Door panel 2 may be made of various materials. Thus, for example, it may consist of a Masonite board sandwiched between and attached to two metal (i.e. aluminum) sheets, or be made wholly of wood, or be a laminate consisting of wood sandwiched between and bonded to two plastic outer layers.

The door panel 2 may have a transparent view window or port 31 and a tough resilient wear plate 16 near its lower end. Although not shown, it is to be understood that both sides of panel 2 may have a wear plate. The wear plate 16 may be made of various materials, including a sheet metal like aluminum or steel, or a tough, resilient plastic material such as a vinyl plastic.

Figure 2:
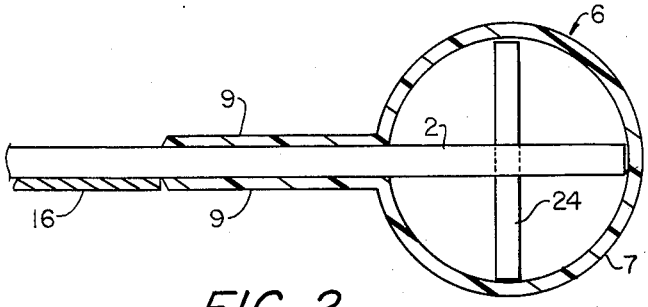
FIG. 2 is a fragmentary sectional view of the door nose taken along line 2—2 in FIG. 1.

FIG. 2 illustrates the relationship of a roll pin 24 with nose 6. The latter comprises a section 7 in the form of a split tube and two parallel flanges 9. Door panel 2 is embraced by and extends between flanges 9. Preferably the edge of panel 2 engages or lies close to the inner surface of section 7 at a point about 180° removed from the point where section 7 is split and is attached to flanges 9. Preferably but not necessarily, section 7 is cylindrical. Any attempt to move the nose 6 laterally is blocked by pins 24 whose length is made so as to be substantially the same as the internal diameter of tubular section 7. Pins 24 are preferably held rigidly in place by panel 2. Lengthwise movement of nose 6 may be prevented by two end caps 32 (see FIG. 3). FIG. 2 also illustrates the relatively smooth outer surface formed by the juxtaposition of wear plate 16 and nose 6.

Figure 3:
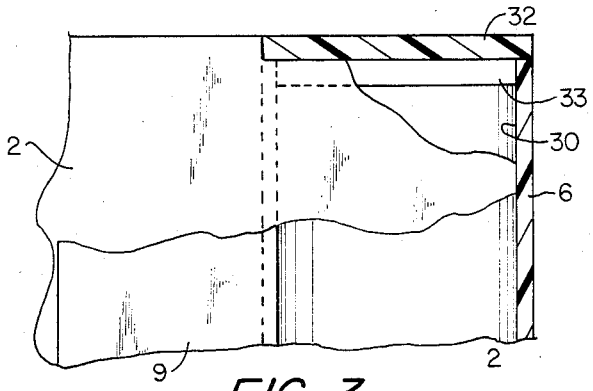
FIG. 3 is a fragmentary sectional front view in elevation of the upper end of the door nose, with an end cap enclosing the top opening of the nose.

As shown in FIG. 3, a top end cap 32 is positioned in the top end of nose 6 so as to close off the interior space of nose 6. Cap 32 may have a slot 33 to accommodate panel 2 and allow the top surface of cap 32 to make a flush fit with the top edges of flanges 9. The upper edge of door panel 2 is notched at its adjacent corner to accommodate cap 32. Nose 6 also is cut back at its section 7 so as to allow cap 32 to be flush with the upper edges of flanges 9. Cap 32 is secured to nose 6, e.g., by an adhesive or a press fit or by a suitable fastener.

A second edge cap 32 (not shown) is attached to the bottom end of nose 6 in the same way, whereby the two end caps function to prevent axial movement of nose member 6.

Figure 4:
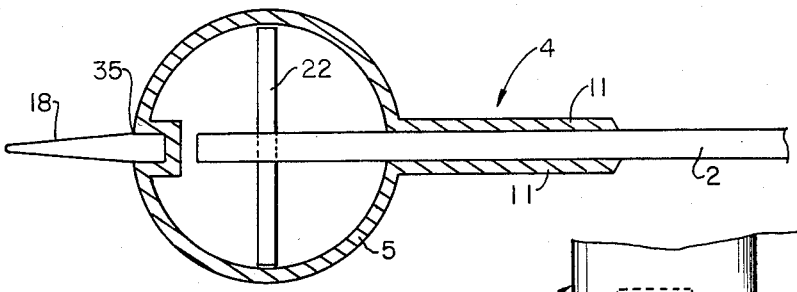
FIG. 4 is a fragmentary sectional view of the door mount taken along line 4—4 in FIG. 1.

Turning to FIG. 4, door mount 4 comprises a split tubular section 5 and two integral flanges 11. Roll pins 22 have a length which is sufficient to allow them to engage diametrically opposite portions of the inner surface of tubular section 5. Preferably roll pins 22 are fixed to panel 2 and are disposed so that equal length portions project from opposite sides of panel 2. Roll pins 22 prevent lateral movement of mount 4 relative to panel 2 in a manner similar to the way in which roll pins 24 hold nose 6 to panel 2. Fasteners 23 pass through flanges 11 and panel 2 to prevent relative lengthwise movement of panel 2 and mount 4.

As an optional measure, FIG. 4 also illustrates a slot 35 formed in the side edge of mount 4 in order to accommodate an air shield 18 made of rubber or other resilient material which engages door jamb 25. Air shield 18 is provided where it is desired to minimize air leakage through a door opening or to slow down temperature equilization between two adjacent spaces separated by door panel 2. Air shield 18 is coextensive with mount 4 and preferably is sized so as to remain engaged with door jamb 25 as the door pivots between closed and open position. Air shield 18 may be secured to mount 4 in any convenient way, e.g., by bonding it in place with a suitable chemical bonding agent.

Figure 5:
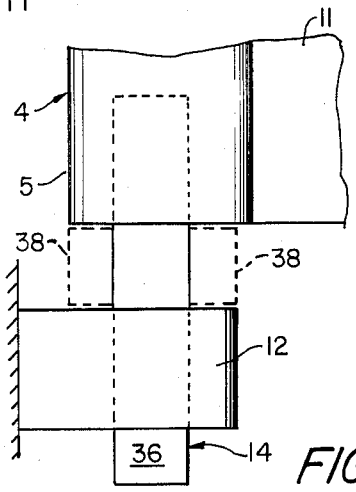
FIG. 5 is a fragmentary front view in elevation of the lower bearing and lower door post section.

FIG. 5 provides a detailed view of lower door post section 14. The upper portion of post 14 extends into and is attached to the lower end of the hollow section 5 of mount 4. The bottom portion of post 14 makes a rotatable fit in lower journal bearing 12 which is attached to the door jamb 25. Post 14 may be secured to mount 4 by a press fit or by means of suitable fasteners (not shown) which may be the same as fasteners 20 both in style and installation. Roller cam follower 28 acts through cam 26 to support the weight of the door, while bearings 10 and 12 cooperate with door posts 8 and 14 to keep the two door posts axially aligned with one another.

A number of variations of the invention described above are possible and are obvious to persons skilled in the art. Thus, for example, the split tubular sections 5 and 7 of the mount 4 and nose 6, respectively, need not have a cylindrical cross-sectional shape. Instead, either or both may have an elliptical, teardrop, polygonal or other shape. Also, the pins 22 and 24 need not be hollow roll pins; instead, they may be solid pins and affixed to the panel by a friction fit or by bonding. Also the pins 22 and 24 need not be fixed to the panel but may make a snug slidable fit in the holes in the panel which receive them. It also is understood that the two post sections 8 and 14 could be parts of a single post which extends for the full length of door mount 4. Also the lower door post section 14 need not be fixed to mount 4. Instead it could make a snug rotatable fit in the lower end of the hollow section 5 of mount 4, in which case it would be formed with a flange as shown in broken lines at 38 in FIG. 5 which overlies and is supported by bearing 12.

The invention has a number of advantages. It provides an easy method of attaching a door mount member and a nose member to a door panel. It also reduces the number of exposed fasteners, thereby improving its appearance and eliminating a number of potential sites for bacteria growth. In the illustrated embodiment, only the ends of fasteners 22 and 23 are exposed. An equally important advantage is that the door mount and door nose members may be made by extrusion and hence can be made of various materials at a relatively low cost. By way of example, door mount 4 may be made of aluminum while door nose 6 may be made of a plastic material such as polyvinyl chloride or polyethylene. Other advantages will be obvious to persons skilled in the art.

Since the foregoing and other changes may be made in the above apparatus without departing from the scope of the invention herein involved, it is intended that all matter contained in the above description or shown in the accompanying drawings shall be interpreted as illustrative and not in a limiting sense.

What is claimed:

1. A door assembly comprising:

a door panel having first and second longitudinally-extending edges at opposite sides thereof;

mounting means attached to said first longitudinally-extending edge for rotatably mounting said door panel to a door frame;

a door edge member attached to said second longitudinally-extending edge of said panel;

said door edge comprising a hollow straight tubular section having a split at a selected point, and first and second straight, parallel flanges formed integral with said hollow tubular section at said split;

said door edge member being slidably assembled to said panel so that said hollow tubular section surrounds said second longitudinally-extending edge of said panel and said flanges extend along opposite sides of said panel away from said second longitudinally-extending edge; and a plurality of hollow-roll pins attached to said panel adjacent said second edge, said pins extending transversely within said hollow tubular section of said door edge member perpendicularly to said panel, said pins having a length which is substantially equal to the maximum internal dimension of said hollow tubular section in a plane extending at a right angle to the plane of said door panel so as to prevent movement of said door edge member in a lateral direction relative to said panel.

2. A door assembly according to claim 1 comprising end caps attached to the opposite ends of said door edge member so as to close off the interior space of said hollow tubular section.

3. A door assembly according to claim 2 wherein said end caps are fixed to said hollow tubular section and cooperate to prevent logitudinal movement of said door edge member relative to said door panel.

4. A door assembly according to claim 1 wherein said hollow tubular section has a generally circular cross-sectional configuration.

5. A door assembly according to claim 1 wherein said mounting means attached to said first longitudinally-extending edge comprises a second door edge member having a hollow straight tubular section surrounding said first longitudinally-extending edge, said hollow tubular section of said second door edge member being split, said second door edge member having straight, parallel flanges formed integral with said hollow tubular section extending along opposite sides of said panel away from said first longitudinally-extending edge, and a second plurality of pins attached to and extending transversely of said panel within said hollow tubular section of said second door edge member.

6. A door assembly according to claim 5 wherein said mounting means comprises pivot post means for said door panel, said pivot post means comprising:

an upper pivot post unit protruding from one end of the hollow tubular section of said second door edge member; and a lower pivot post unit protruding from the opposite end of the hollow tubular section of said second door edge member.

7. A door assembly according to claim 5 wherein said second door edge member has a longitudinally-extending groove in said hollow tubular section thereof, and further wherein a flexible resilient air shield is secured in said groove, said air shield projecting from said groove for engagement with the side of a door jamb to which said door assembly is swingably mounted.

8. A door assembly according to claim 1 wherein said pins are positioned in holes in said door panel and are sized so as to be movable axially in said holes.

9. A door assembly according to claim 1 wherein said pins are hollow roll pins extending perpendicularly to said door panel, and further wherein said pins have a length which is substantially equal to the maximum internal dimension of said hollow tubular section in a plane extending at a right angle to the plane of said door panel.

10. A door assembly comprising:

a door panel having first and second longitudinally-extending edges at opposite sides thereof;

mounting means attached to said first longitudinally-extending edge for rotatably mounting said door panel to a door frame;

a door edge member attached to said second longitudinally-extending edge of said panel;

said door edge member comprising a hollow straight tubular section having a split at a selected point, and first and second straight, parallel flanges formed integral with said hollow tubular section at said split;

said door edge member being slidably assembled to said panel so that said hollow tubular section surrounds said second longitudinally-extending edge of said panel and said flanges extend along opposite sides of said panel away from said second longitudinally-extending edge;

a plurality of pins attached to said panel adjacent said second edge and extending transversely within said hollow tubular section of said door edge member;

said hollow tubular section having a generally circular cross-sectional configuration; and said pins having lengths substantially equal to the internal diameter of said hollow tubular section, so as to prevent movement of said door edge member in a lateral direction relative to said panel.

11. A door assembly comprising:

a door panel having first and second longitudinally-extending edges at opposite sides thereof;

mounting means attached to said first longitudinally-extending edge for rotatably mounting said door panel to a door frame;

a door edge member attached to said second longitudinally-extending edge of said panel;

said door edge member comprising a hollow straight tubular section having a split at a selected point, and first and second straight, parallel flanges formed integral with said hollow tubular section at said split;

said door edge member being slidably assembled to said panel so that said hollow tubular section surrounds said second longitudinally-extending edge of said panel and said flanges extend along opposite sides of said panel away from said second longitudinally-extending edge; and a plurality of pins attached to said panel adjacent said second edge and extending transversely within said hollow tubular section of said door edge member, said pins being positioned in holes in said door panel and sized so as to be movable axially in said holes, said pins having a length sufficient to prevent movement of said door edge member in a lateral direction relative to said panel.

12. A door assembly comprising:

a door panel having first and second longitudinally-extending edges at opposite sides thereof;

mounting means attached to said first longitudinally-extending edge for rotatably mounting said door panel to a door frame;

said mounting means comprising a door edge member attached to said first longitudinally-extending edge of said panel and first post means coupled to said door edge member;

said door edge member comprising a hollow straight tubular section having a split at a selected point and first and second straight, parallel flanges formed integral with said hollow tubular section at said split;

said door edge member being assembled to said panel so that said hollow tubular section surrounds said first longitudinally-extending edge of said panel and said flanges extend along opposite sides of said panel away from said first longitudinally-extending edge;

a plurality of pins attached to said panel adjacent said first edge and extending transversely within said hollow tubular section of said door edge member perpendicularly to said panel, said pins having a length sufficient to prevent movement of said door edge member in a lateral direction relative to said panel; and means for preventing longitudinal movement of said door edge member relative to said panel;

said pivot post means protruding axially from the opposite ends of said hollow tubular section of said door edge member for rotatable attachment to a door frame.

13. A door assembly according to claim 12 wherein said pivot post means comprises an upper pivot post unit protruding from one end of the hollow tubular section of said door edge member, and a lower pivot post unit protruding from the opposite end of the hollow tubular section of said door edge member.

14. A door assembly according to claim 13 further including means locking at least one of said post units to said door edge member so that said door edge member and said panel will rotate with said at least one post unit.

15. A door assembly according to claim 12 wherein said door edge member has a longitudinally-extending groove in said hollow tubular section thereof, and further wherein a flexible resilient air shield is secured in said groove, said air shield projecting from said groove for engagement with the side of a door jamb to which said door assembly is swingably mounted.

16. A door assembly according to claim 12 wherein said pins are positioned in holes in said door panel and are sized so as to be movable axially in said holes.

17. A door assembly according to claim 12 wherein said pins are hollow roll pins.

* * * * *